US007638721B2

(12) United States Patent
Rehbein et al.

(10) Patent No.: US 7,638,721 B2
(45) Date of Patent: Dec. 29, 2009

(54) CONTACT SURFACES FOR ELECTRICAL CONTACTS

(75) Inventors: Peter Rehbein, Weissach (DE); Volker Haas, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 242 days.

(21) Appl. No.: 10/574,879

(22) PCT Filed: Aug. 3, 2004

(86) PCT No.: PCT/DE2004/001733

§ 371 (c)(1),
(2), (4) Date: Jan. 19, 2007

(87) PCT Pub. No.: WO2005/046000

PCT Pub. Date: May 19, 2005

(65) Prior Publication Data

US 2007/0275611 A1 Nov. 29, 2007

(30) Foreign Application Priority Data

Oct. 6, 2003 (DE) ..... 103 46 206

(51) Int. Cl.
*H01R 4/58* (2006.01)

(52) U.S. Cl. ..... 200/265; 29/874; 29/885; 174/126.1; 174/126.2; 200/267; 200/270; 428/336; 428/614; 428/615; 428/634; 428/673; 428/674; 428/929; 428/935

(58) Field of Classification Search ..... 428/615, 428/634, 674, 673, 215, 216, 220, 336, 332, 428/614, 929, 935; 200/265, 267, 270; 174/126.1, 174/126.2; 29/874, 885; 307/90.1
See application file for complete search history.

(56) References Cited

U.S. PATENT DOCUMENTS

| | | | | | |
|---|---|---|---|---|---|
| 4,622,269 | A | * | 11/1986 | Leung et al. | 200/265 |
| 4,699,763 | A | * | 10/1987 | Sinharoy et al. | 252/514 |
| 5,028,492 | A | | 7/1991 | Guenin | |
| 5,199,553 | A | | 4/1993 | Shinohara et al. | |
| 5,445,895 | A | * | 8/1995 | Behrens et al. | 428/567 |
| 5,916,695 | A | | 6/1999 | Fister et al. | |
| 5,967,860 | A | | 10/1999 | Ricketts et al. | |

FOREIGN PATENT DOCUMENTS

| | | |
|---|---|---|
| DE | 41 33 466 | 5/1992 |
| EP | 0 729 162 | 8/1996 |
| EP | 0 825 682 | 2/1998 |
| GB | 1 534 429 | * 12/1978 |
| GB | 2 251 133 | 6/1992 |

OTHER PUBLICATIONS

International Search Report, PCT International Patent Application No. PCT/DE2004/001733, dated Nov. 24, 2004 (translated).
Written Opinion of the International Searching Authority, PCT/ISA/237, PCT International Patent Application No. PCT/DE2004/001733 (translated).

* cited by examiner

*Primary Examiner*—Archene Turner
(74) *Attorney, Agent, or Firm*—Kenyon & Kenyon LLP

(57) ABSTRACT

A contact surface. for electrical contacts may include an Ag layer deposited on a copper-based substrate using galvanic methods. The Ag layer includes finely dispersed graphite particles in a quantity of, e.g., 1 to 3 weight % of the Ag layer, the graphite particles having a length in the range of, e.g., 0.5 to 20 μm.

8 Claims, 1 Drawing Sheet

CONTACT SURFACES FOR ELECTRICAL CONTACTS

FIELD OF THE INVENTION

The present invention relates to improved contact surfaces for electrical contacts.

BACKGROUND INFORMATION

Electrical connectors such as bushings and plugs are typically produced from a substrate made of an alloy on copper basis, which provides good electrical conductivity. If the electrical connector is exposed to higher temperatures during operation, such as under the engine hood of a motor vehicle, the substrate is made from an alloy on copper basis having high stability and a high strain-relaxation resistance.

A cover layer is often applied on the substrate to reduce tarnishing of the copper-based substrate at higher temperatures and to improve the soldering ability. Typical cover layers are made of nickel, palladium/nickel alloys, tin or tin alloys. To minimize costs, tin is often used, predominantly fire-tinned or galvanically deposited layers in the range of a few μm. Tin is characterized by its ductility and its excellent electrical conductivity.

The substrate is usually made of copper-based alloys such as $CuSn_4$-bronze, CuNiSi, etc., which often serve as base material for electrical plug-in connections. At higher temperatures it may happen that copper diffuses out of the substrate and combines with the tin, forming intermetallic compounds such as $Cu_6Sn_5$ and $Cu_3Sn$. The formation of such intermetallic compounds reduces the quantity of unreacted or free tin on the surface. This has a detrimental effect on the electrical, corrosion and other performance characteristics.

A "tin layer" produced by heat treatment is referred to as thermo-tin, which is made of intermetallic phases to 100%. Also frequently used are AuCo alloys having nickel undercoating, and Ag surfaces, partly having copper undercoating or nickel undercoating.

So far, however, thermo tin has not shown to be a successful solution in all test situations (such as chemical testing or abrasive loading), and therefore has no more than a very small marketing share.

Moreover, it is conventional that tin alloys, due to their low hardness or their low wear resistance, have a tendency to increased oxidation (chafing corrosion) and to abrasion as a result of frequent plug-ins or vehicle-related or engine-related vibrations in the plug connector. This abrasion or chafing corrosion may lead to malfunctioning of a component (sensor, control unit, electrical components in general).

In addition, due to the high adhesion tendency and the plastic deformation, the plug forces are too high for many application situations such as plug connectors having a high number of (poles, e.g., >100 pins or contacts). Surfaces on the basis of tin and silver, in particular, have a cold welding tendency because of adhesion, and in self pairings are characterized by high friction values (coefficients of friction).

Even with conventional silver or gold layers, tribological wear mechanisms of the base material or the intermediate layer (frequently Cu or Ni) may occur with layer abrasion or layer chipping, due to poor adhesion.

EU directive "Altautorichtlinie" 2000/53 forbids the use of lead-containing tin layers. Since the lead inhibits whisker formation (whiskers are tiny, hair-like crystals), galvanic pure tin promotes whisker growth, which may lead to short-circuits.

In U.S. Pat. No. 5,028,492, a composite coating for electrical contacts is described, which includes a ductile metal matrix and a uniformly distributed polymer component. The polymer component is present in a concentration that reduces the frictional forces that occur when a contact is inserted into a corresponding receptacle. The composite coating provides lower friction and improved frictional oxidation compared to a galvanically deposited tin coating.

U.S. Pat. No. 5,916,695 describes an electrical contact having a copper-based substrate, which has been provided with a tin-based cover layer. To prevent diffusion of the copper from the substrate into the cover layer and the attendant formation of intermetallic layers, a barrier layer is applied between the substrate and the cover layer. This barrier layer contains 20 to 40 weight % of tin and preferably is mostly made up of copper (Cu base). Among others, the tin-based cover layer may include additives such as $SiO_2$, $Al_2O_3$, SiC, graphite or $MOS_2$ as lubricants.

SUMMARY

In contrast to the foregoing, the contact surfaces according to example embodiments of the present invention may provide that they require low plug-in forces while still supplying excellent electrical contacting.

Moreover, it may be provided that they protect the surface from corrosion due to the antioxidants contained in the lubricant.

Furthermore, increased wear protection and thus of an increased service life of the contacts may be provided.

Example embodiments of the present invention are described in greater detail below with reference to the appended FIGURE.

BRIEF DESCRIPTION OF THE DRAWING

The FIGURE illustrates the arrangement of the graphite particles in an Ag contact layer.

DETAILED DESCRIPTION

Figure 1:
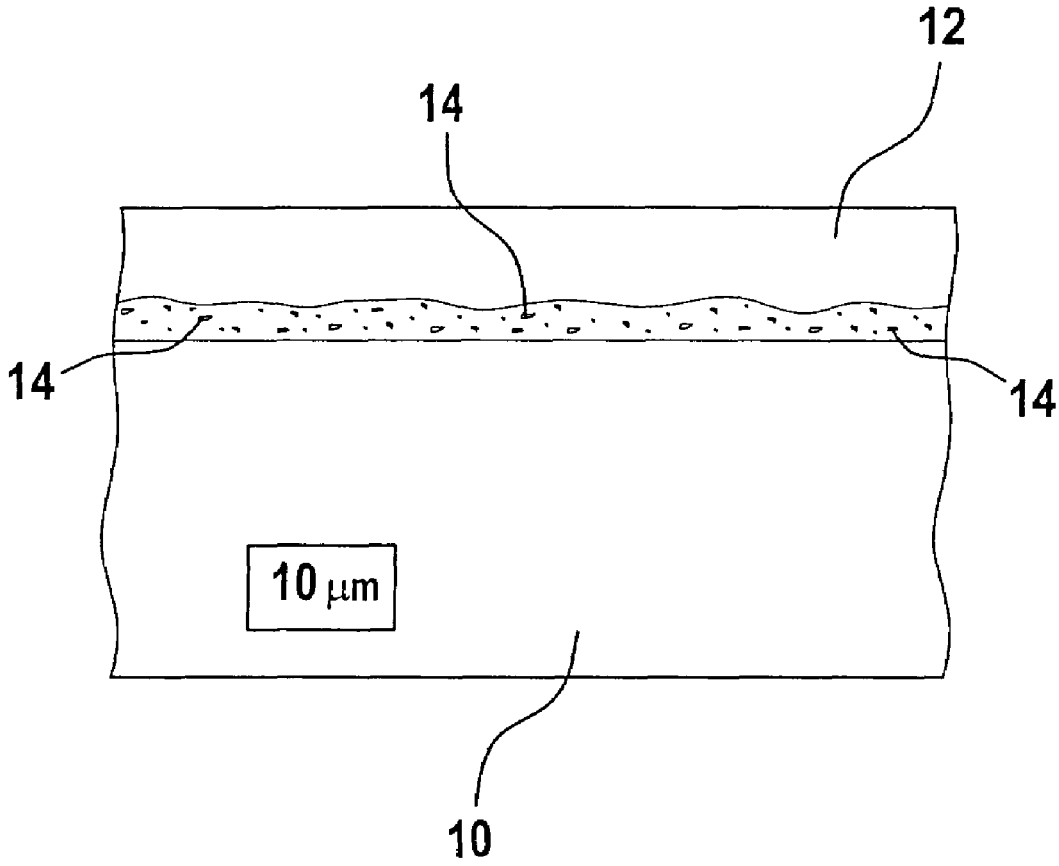

Example embodiments of the present invention provide for the construction of an Ag cover layer, which has finely dispersed graphite particles embedded therein, on a copper-based substrate for electrical contacts in the automobile, which may require lower plug-in forces while providing the same satisfactory contacting.

As illustrated in the FIGURE, an Ag contact surface 12 is first produced on the electrical contact, i.e., on copper-based substrate 10, using galvanic methods such as baths or reel-to-reel methods.

The Ag layer may be deposited with or also without intermediate layers as diffusion barriers, such as a tin undercoating, and also with or without flash of noble metals such as Au, Pt, Ru or Pd.

The layer thickness of the deposited Ag layer may be between approximately 1.0 and approximately 10 μm, depending on the application.

Finely dispersed graphite particles 14 are introduced into the Ag layer, for example, by intermingling of graphite and chemical auxiliary agents for binding (wetting agent), the graphite quantities being in the range of, e.g., 1 to 3 weight % of carbon of the Ag layer, or in the range of, e.g., 3 to 10 surface % of carbon. The graphite particles may be present as platelets or flakes and have a length of, e.g., between 1 and 10 μm, a thickness, e.g., in the range of 0.05 to 2 μm, and a width, e.g., in the range of 0.05 to 2 μm. It may be provided that the maximum value for thickness and width, i.e., 2 μm, does not occur simultaneously. The graphite particles may be disposed anisotropically along the habitus plane of the Ag layer, i.e., along the longest axis of the layer plane (cf. the Figure).

The aspect ratio of the graphite particles, i.e., the ratio of length to thickness, may be, e.g., 1:2 to 1:40.

The contact surfaces may allow lower plug-in forces as a result of the included graphite lubricant. Good contacting may be ensured by the electrical conductivity of the lubricant. Antioxidants included in the lubricant protect the surfaces from corrosion, thus providing high wear resistance and a high number of plug-in cycles.

The contact surfaces may be used in electrical contacts in automotive plug connections that are in close proximity to the engine.

What is claimed is:

1. A contact surface for an electrical contact, comprising:

an Ag layer galvanically deposited on a copper-based substrate, the Ag layer including finely dispersed graphite particles in a quantity of between 1 and 3 weight % of the Ag layer, the graphite particles having a length in a range of 0.5 to 20 μm;

wherein each of the graphite particles does not simultaneously include a maximum thickness and a maximum width.

2. The contact surface according to claim 1, wherein the graphite particles have a length in the range of 1 to 10 μm.

3. The contact surface according to claim 1, wherein the graphite particles have a thickness in the range of 0.05 and 2 μm.

4. The contact surface according to claim 1, wherein a ratio of thickness to length of the graphite particles is in the range of 1:2 to 1:40.

5. The contact surface according to claim 1, wherein the graphite particles are arranged at least one of (a) anisotropically and (b) statistically along a habitus plane of the Ag layer.

6. The contact surface according to claim 1, wherein a layer thickness of the Ag layer is in the range of approximately 1 to approximately 10 μm.

7. The contact surface according to claim 1, wherein the graphite particles have a width in the range of 0.05 and 2 μm.

8. A method, comprising:

providing a contact surface in an automotive plug connection in close proximity to an engine, the contact surface including an Ag layer galvanically deposited on a copper-based substrate, the Ag layer including finely dispersed graphite particles in a quantity of between 1 and 3 weight % of the Ag layer, the graphite particles having a length in a range of 0.5 to 20 μm;

wherein each of the graphite particles does not simultaneously include a maximum thickness and a maximum width.

* * * * *

UNITED STATES PATENT AND TRADEMARK OFFICE

CERTIFICATE OF CORRECTION

PATENT NO. : 7,638,721 B2
APPLICATION NO. : 10/574879
DATED : December 29, 2009
INVENTOR(S) : Rehbein et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 77 days.

Signed and Sealed this

Ninth Day of November, 2010

David J. Kappos

David J. Kappos
*Director of the United States Patent and Trademark Office*